US006557204B2

(12) United States Patent
Maxwell

(10) Patent No.: US 6,557,204 B2
(45) Date of Patent: May 6, 2003

(54) MESH SPONGE HOLDER/BACK SCRUBBER

(76) Inventor: Daryl Wayne Maxwell, 2601 Habersham Ave., Nashville, TN (US) 37214

( * ) Notice: Subject to any disclaimer, the term of this patent is extended or adjusted under 35 U.S.C. 154(b) by 0 days.

(21) Appl. No.: 09/875,360

(22) Filed: Jun. 5, 2001

(65) Prior Publication Data

US 2001/0047564 A1 Dec. 6, 2001

Related U.S. Application Data

(60) Provisional application No. 60/209,693, filed on Jun. 6, 2000.

(51) Int. Cl.[7] ..... A47K 7/02
(52) U.S. Cl. ..... 15/210.1; 15/229.13; 15/244.1
(58) Field of Search ..... 15/244.1, 209.1, 15/210.1, 147.2, 229.11, 229.13

(56) References Cited

U.S. PATENT DOCUMENTS

| | | | | |
|---|---|---|---|---|
| 315,814 | A | * | 4/1885 | Morgan |
| 666,847 | A | | 1/1901 | Emmert |
| 723,462 | A | | 3/1903 | Hart |
| 1,723,520 | A | | 8/1929 | Pintel |
| 2,637,871 | A | | 5/1953 | Moser |
| 2,710,420 | A | | 6/1955 | Granat |
| 2,936,471 | A | | 5/1960 | Coleman |
| 3,061,861 | A | | 11/1962 | Hartmann |
| 3,220,040 | A | | 11/1965 | Knaebe |
| 3,570,038 | A | * | 3/1971 | Jones |
| 4,571,766 | A | | 2/1986 | Goldman et al. |
| 4,974,286 | A | * | 12/1990 | Stowell |
| 5,058,234 | A | | 10/1991 | Humenay |
| 5,659,916 | A | * | 8/1997 | Beatty |
| 5,887,310 | A | | 3/1999 | Wright |

* cited by examiner

*Primary Examiner*—Randall E. Chin

(57) ABSTRACT

A device with a handle, for securing a sponge, mesh sponge or other medium with a string or cord attached, and used for the purpose of bathing, massaging or applying a substance to ones body and more precisely to ones back or other hard to reach areas of the body. An improved back and/or body scrubber which holds a common mesh sponge or similar item, and allows for its quick installation and removal. The invention is comprised of a handle (7), which acts as a housing to contain plug (2), spring (3), finger pilot (4), finger (5), and pusher (6). Along with cap (9), these components work together as a spring-loaded unit for the purpose of pulling and holding a mesh sponge, or similar item, by its string or cord, into head (1) through a slot in the side of head (1). The purpose of the bell or cone shaped head (1) is to gather and push forward the folds or surfaces, of a mesh sponge or similar item, creating a wide and stable surface suitable for scrubbing or washing ones body. Gripper (8) is attached to handle (7) and provides a soft and textured surface for gripping handle (7) in a wet and soapy environment.

2 Claims, 6 Drawing Sheets

5
4

10

6
10

11

8
7

12

11
12

9
9A
9A

9A 11
9
12

9A
13

13
3

2

14

MESH SPONGE HOLDER/BACK SCRUBBER

BACKGROUND—CROSS-REFERENCES TO RELATED APPLICATIONS

This invention is related to my pending provisional patent application, No. 60/209,693, filed Jun. 6, 2000.

BACKGROUND—FIELD OF INVENTION

This invention relates to back scrubbers for bathing, specifically to an improved method for holding a mesh sponge for the purpose of bathing hard to reach areas of the body.

BACKGROUND—DESCRIPTION OF PRIOR ART

The dilemma of how to wash one's back is as old as bathing itself. A washcloth held at the corners with one hand at the shoulder and the other at the waist works for some people but is very awkward and washcloths do not lather well with liquid soap. Brushes, Loofahs and other sea grass type back scrubbers are often harsh and also do not lend themselves to lathering with liquid soap. Back scrubbers incorporating a mesh sponge are somewhat better because they lather very well with liquid or bar soap, rinse easily, dry fast and come in an assortment of colors to match the decor of the bathroom. However, these mesh sponge type back scrubbers do not securely hold the sponge to facilitate bathing and/or are designed in such a way that only a small portion of the sponge is used making them very inefficient.

The prior art in back scrubbers has many faults, but the main problem with all of these back scrubbers is that you must first apply soap before use, and few people go to the trouble of rinsing one item just to soap up another.

To summarize, there are a variety of back scrubbers and back brushes on the market, but many of them are not conducive to lathering, are harsh to the skin, or are not designed well for use with a mesh sponge. The primary problem with back scrubbers though, is that they require soaping before use.

OBJECTS AND ADVANTAGES

Accordingly, several objects and advantages of my invention are in its overall design. Its uniqueness lies in the manner in which the back scrubber loads and uses the same mesh sponge that has already had soap applied for use in bathing the arms and body front. It takes only a few seconds to load a common mesh sponge and begin bathing your back, legs, feet or any other area of the body, without having to bend or stretch. While other back scrubbers require the use of a separate sponge or brush, this unique product requires only one soaping of a common mesh sponge.

Its bell shaped head is designed to securely hold and push forward the surfaces of the mesh sponge providing a wide and stable surface for scrubbing. The design also incorporates a hip actuated spring mechanism, which makes it easy to load and unload.

Further objects and advantages of my invention will become apparent from a consideration of the drawings and ensuing description.

DRAWING FIGURES

In the drawings, closely related figures have the same number but different alphabetic suffixes. All drawings are in perspective view and ¼" scale.

REFERENCE NUMERALS IN DRAWINGS

1. Head
2. Plug
3. Spring
4. Finger Pilot
5. Finger
6. Pusher
7. Handle
8. Gripper
9. Cap
9A. Cap (cutaway view)
10. Finger Sub-Assembly
11. Pusher Assembly
12. Handle Assembly
13. Handle/Pusher Assembly
14. Handle Mechanism
15. Mesh Sponge
15A. Mesh Sponge Cord

SUMMARY

In accordance with the present invention a mesh sponge holder/back scrubber comprises a handle mechanism and a head. The handle mechanism is made up of a handle/pusher assembly, a spring and a plug. The handle/pusher assembly is made up of a handle assembly and a pusher assembly, which are made up of a handle, gripper, pusher, finger, finger pilot, and cap.

Description

Figure 1:
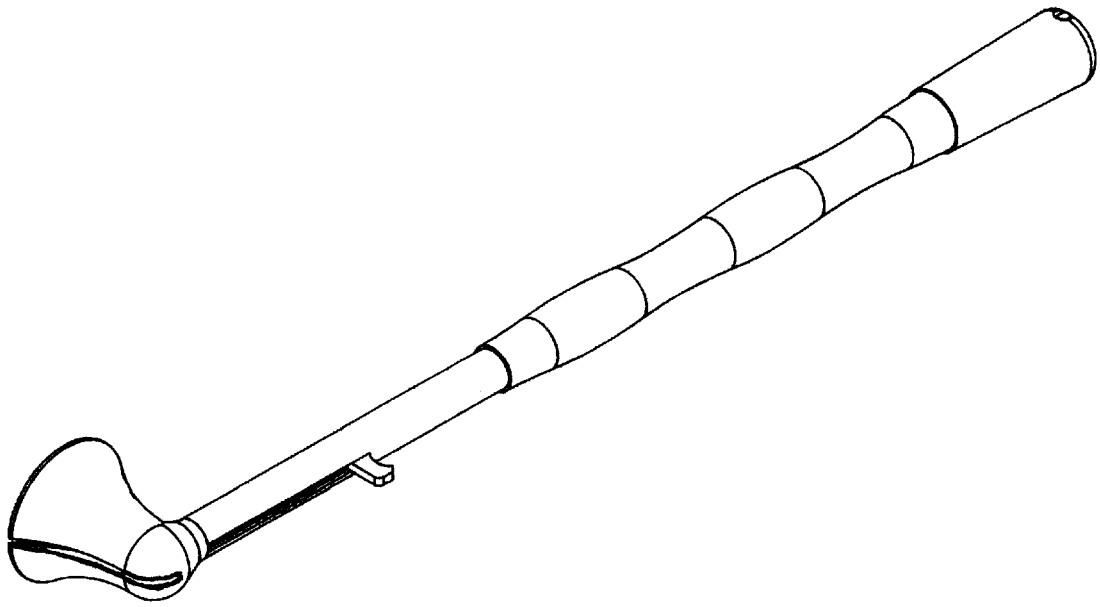
FIG. 1 shows the mesh sponge holder/back scrubber in its entirety.
Figure 2:
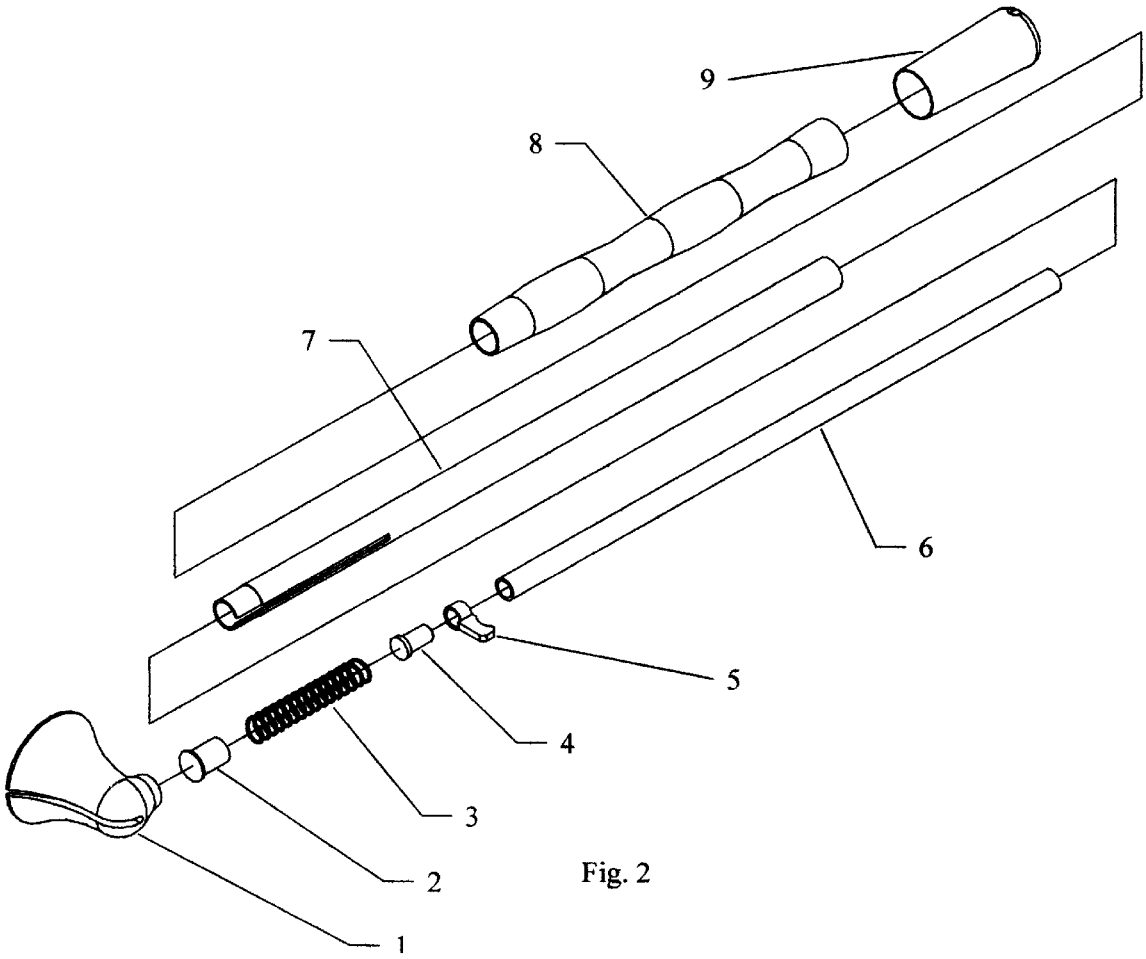
FIG. 2 shows an exploded view of the mesh sponge holder/back scrubber in its entirety.

FIG. 1 shows a perspective view of a basic version of my mesh sponge holder/back scrubber. In FIG. 2, the exploded view shows all nine parts that comprise the mesh sponge holder/back scrubber and their relative position for assembly. Each of these parts with the exception of the gripper (8) and spring (3) should be made of a plastic with a cure hardness of around 75 D durometer, or hard enough to be durable yet soft enough to bend significantly before fracturing.

FIG. 2 shows a head (1) in the shape of a bell or cone with an inside diameter of approximately 3" and tapering down approximately 2" to an inside diameter of about ½". Head (1) having a slot starting on one side and extending through its axial length to its center or axis. On the opposite side of this slot is a bore slightly smaller than the outside diameter of the necked down end of a handle (7) FIG. 2, so as to create a snug fit between a head (1) and a handle (7). The axis of this bore is perpendicular to the axis of head (1) and extends through to the slot without protruding into the inside tapered bore of the head. Sufficient material should be located around this bore on head (1) to provide support for handle (7).

Plug (2) FIG. 2 has the shape of a pin with a head, having a mirror diameter extending approximately 7/16" on one end and slightly smaller in diameter than the inside diameter of handle (7) FIG. 2 so as to create a snug fit into handle (7). On the other end of plug (2) and extending approximately 1/16" is a shoulder with a diameter equal to the outside diameter of handle (7) at the necked down area.

A spring (3) FIG. 2 has an outside diameter of approximately ⅝" with a length of approximately 4" and having a load rate of around 6 lbs/in. or strong enough to keep a mesh sponge pulled tight against a head (1).

A finger pilot (4) FIG. 2 has the shape of a pin with a body and head. The body has an outside diameter extending ⅞" and slightly smaller than the inside diameter of a pusher (6) so as to create a snug fit. At the other end is a head extending a length of ⅛" with an outside diameter equal to the outside diameter of a pusher (6) FIG. 2.

A finger (5) FIG. 2 is round with a section slightly smaller than 3/16" wide and approximately ⅞" long, radially protruding from one side. Having a hole through the center slightly larger than the outside diameter of the body of a finger pilot (4) FIG. 2 so as to allow a running fit.

A pusher (6) FIG. 2 has the shape of a length of pipe having an outside diameter of approximately ⅝" and an inside diameter of approximately 15/32" with a length of approximately 19".

A handle (7) FIG. 2 has the shape of a length of pipe with an outside diameter of approximately ⅞" and an inside diameter of about 23/32" with a total length of approximately 18". Handle (7) FIG. 2 having a slot 3/16" wide, or wide enough for the protrusion on a finger (5) FIG. 2 to slide and work in, and the slot being through the entire wall thickness on one side starting at one end of handle (7) and extending approximately 5¼" parallel with the axis of handle (7). A shoulder on the same slotted end of said handle is created by necking down that same slotted end of handle (7) about 0.020" per side, for a length of about ⅞".

A gripper (8) FIG. 2 is made of a soft urethane or equivalent material at about 40A–45A dyrometer and having a porous and contoured outer surface consistent with gripping in a wet and soapy environment, is over molded onto a handle (7) FIG. 2 such that the end of the gripper and the end of the handle opposite the slot are flush. After the over molding process, handle (7) and gripper (8) become handle assembly (12).

A cap (9) FIG. 2 has two bores, the largest of which is larger than the outside diameter of a gripper (8) FIG. 2 so as to provide clearance. The second bore extends about 7/16" with an inside diameter slightly larger than the outside diameter of a pusher (6) FIG. 2 so as to create a snug fit with a pusher (6) and also extends ⅜" from the back of cap (9). The outside diameter of cap (9) starts at the open end and is approximately 3⅜", extending a length of about 3¾" and having an ascending taper of about two degrees per side. There are also openings in the back of cap (9) to allow for drainage.

Figures 3A, 3B, 4A, 4B, 5A, 5B, 5C:
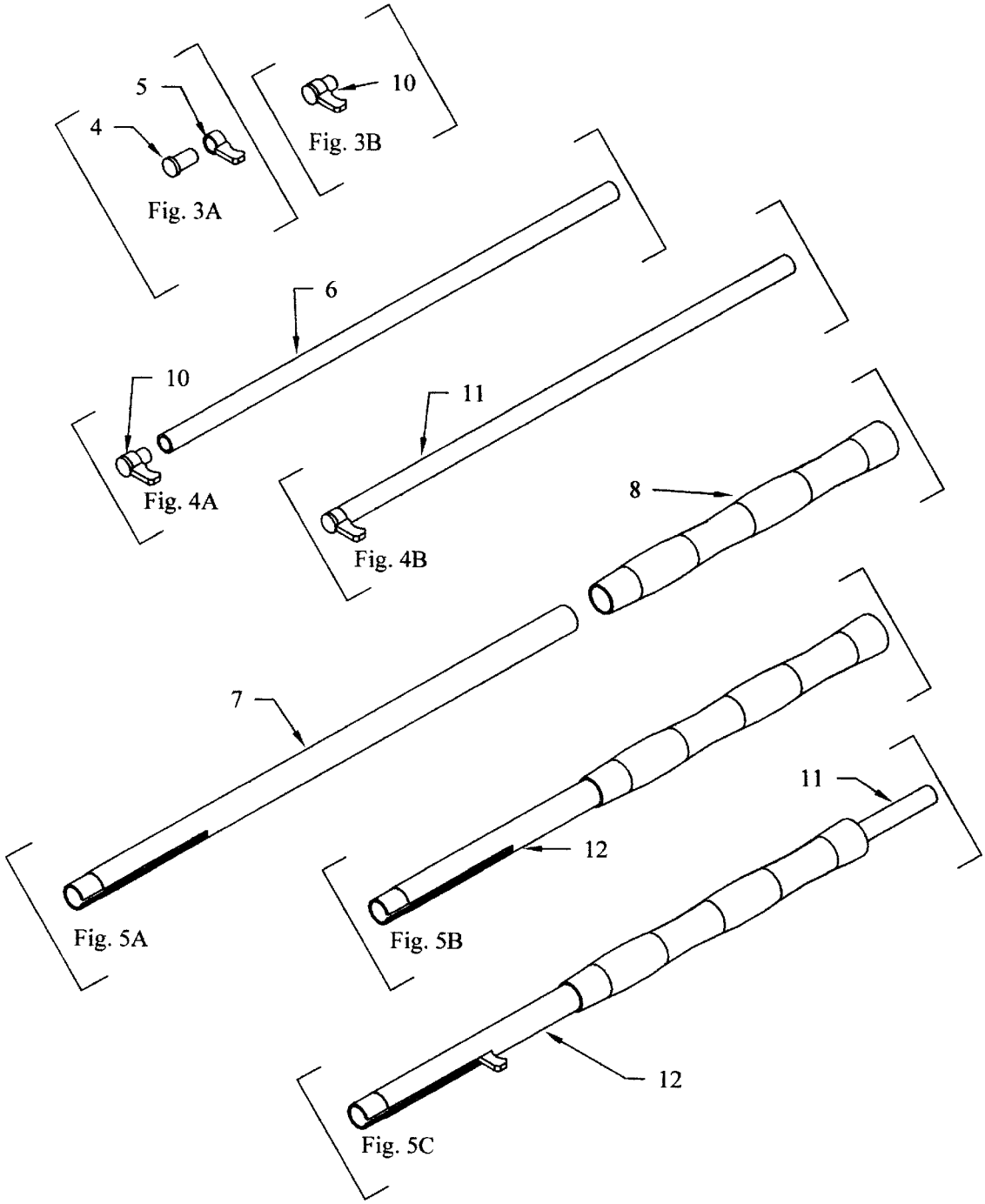
FIG. 3A shows a finger pilot (4) and a finger (5).
FIG. 3B shows the resulting finger sub-assembly (10) of a finger pilot (4) and finger (5).
FIG. 4A shows a finger sub-assembly (10) and a pusher (6).
FIG. 4B shows the resulting pusher assembly (11) of a finger sub-assembly (10) and a pusher (6).
FIG. 5A shows a handle (7) and a gripper (8).
FIG. 5B shows the resulting handle assembly (12) of a handle (7) and a gripper (8).
FIG. 5C shows a pusher assembly (11) installed inside a handle assembly (12).
Figures 6A, 6B, 6C, 6D, 7A, 7B, 7C:
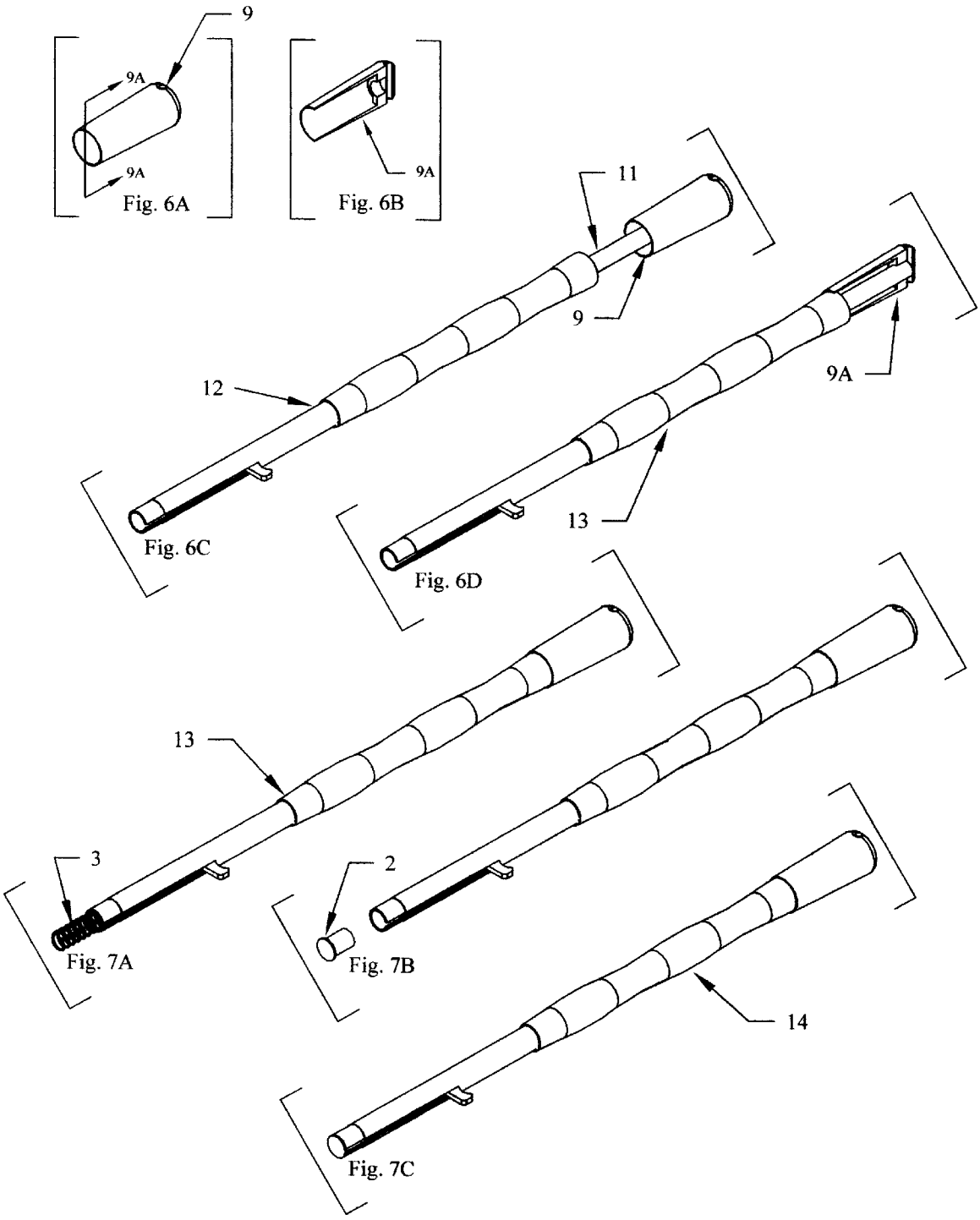
FIG. 6A shows a cap (9).
FIG. 6B shows a cut away view, used only for clarity, of a cap (9A).
FIG. 6C shows a pusher assembly (11) inside a handle assemble (12) with a cap (9) being installed onto the end of the pusher assembly (11).
FIG. 6D shows the resulting handle/pusher assembly (13) of a handle assembly (12) inside a pusher assembly (11) with a cap (9), shown in its cutaway view (9A) for clarity, fully installed onto the pusher assembly (11).
FIG. 7A shows a handle/pusher assembly (13) with a spring (3) being installed.
FIG. 7B shows a handle/pusher assembly (13) with a fully installed spring (3), and a plug (2).
FIG. 7C shows a handle mechanism (14) of a handle/pusher assembly (13), spring (3) and plug (2).
Figure 8:
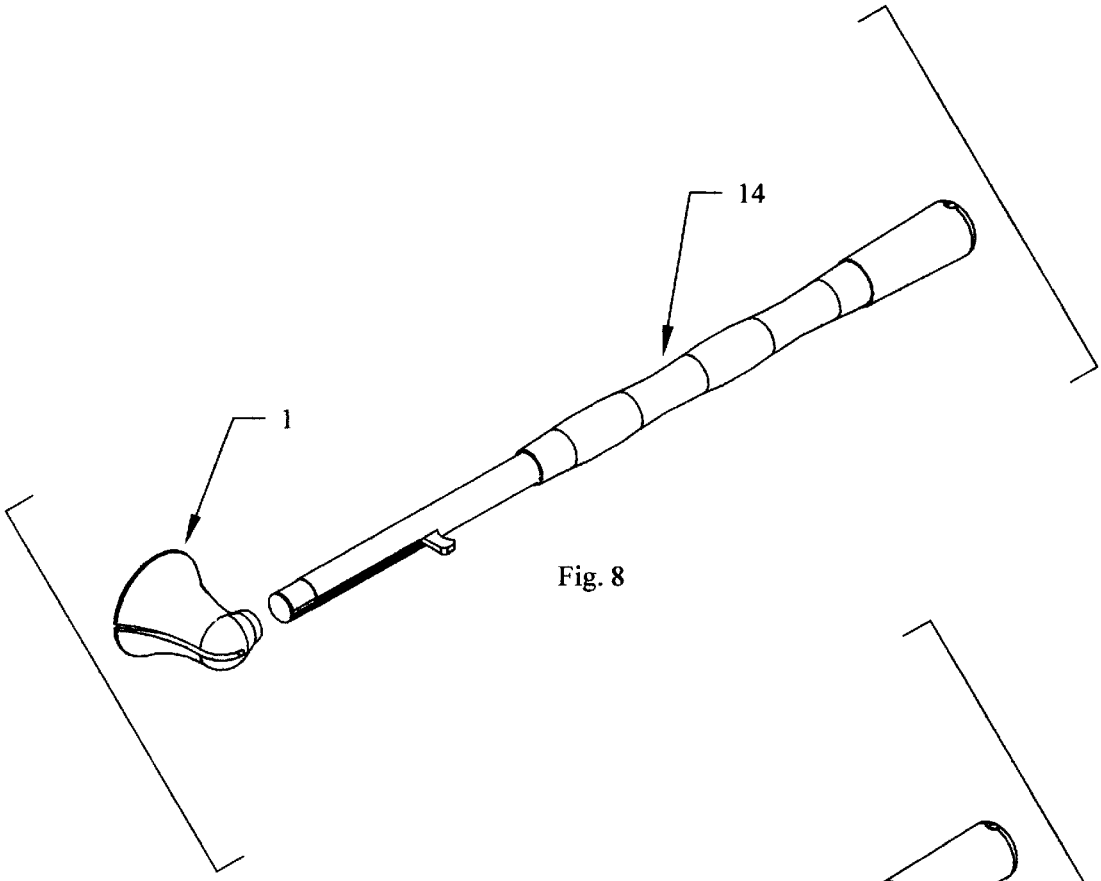
FIG. 8 shows a handle mechanism (14) and a head (1).
Figure 9:
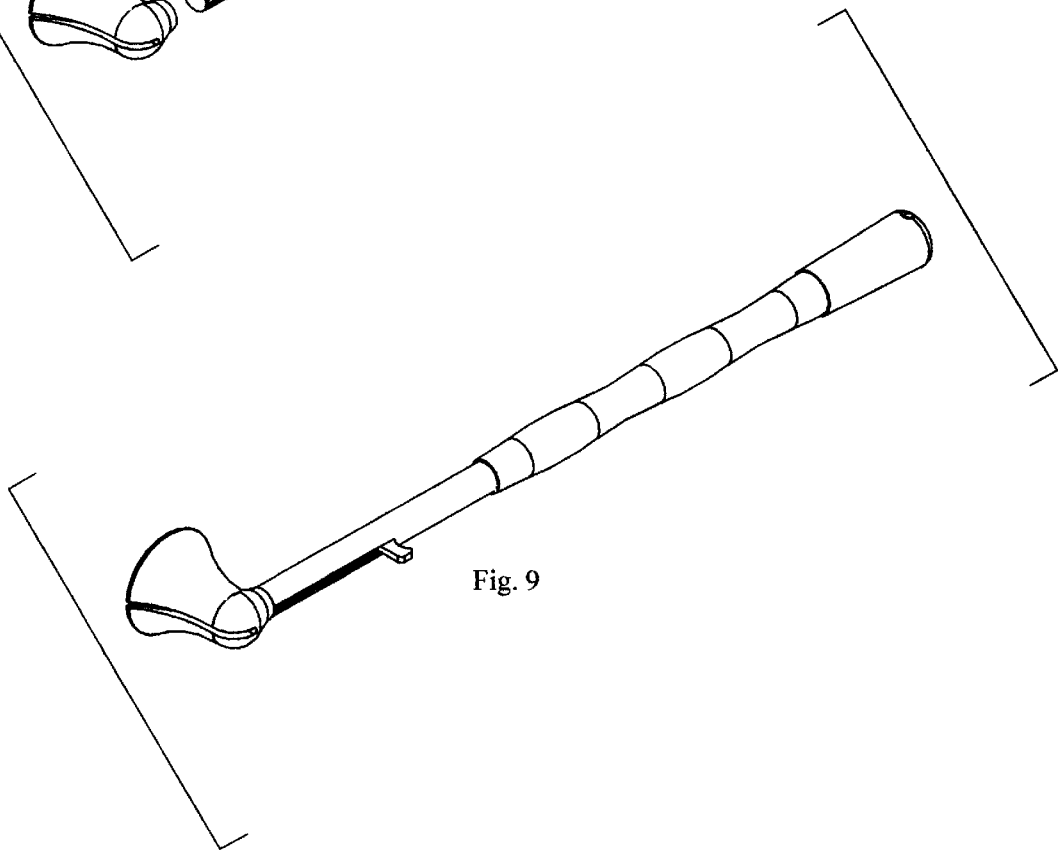
FIG. 9 shows a completed mesh sponge holder/back scrubber of a handle mechanism (14) and a head (1).

The assembly of the mesh sponge holder/back scrubber starts by the insertion of a finger pilot (4) FIG. 3A into the hole of a finger base (5) FIG. 3 so that the head of finger pilot (4) sits down into the counterbore of finger base (5) to create a finger sub-assembly (10) as shown in FIG. 3B. A small amount of glue is put on the inside of one end of pusher (6) FIG. 4A and the pilot end of finger sub-assembly (10) is inserted into pusher (6) to create a pusher assembly (11) as in FIG. 4B. As previously mentioned a gripper (8) FIG. 5A is over molded onto handle (7) to create a handle assembly (12) FIG. 5B. A pusher assembly (11) FIG. 4B is then inserted into handle assembly (12) as in FIG. 5B, making sure the protruding finger goes into the slot of the handle assembly (12) as in FIG. 5C. A small amount of glue is placed on the inside of cap (9) FIG. 6 at the small inside bore, which is shown in the cut-away view cap (9A) FIG. 6. Then the cap (9) FIG. 6B is installed onto pusher assembly (11) FIG. 6B while pusher assembly (11) is inside handle assembly (12) as in FIG. 6B. FIG. 6C shows a fully installed cap (9B) cutaway view for clarity. A spring (3) is inserted into the slot end of handle assembly (13) as in FIG. 7A. Then a small amount of glue is placed inside the slot end of the handle assemble (13) and a plug (2) FIG. 7B is inserted into the slot end of handle assembly (13) creating an assembly mechanism (14) as in FIG. 7C. Shown in FIG. 8, are a handle mechanism (14) and a head (1). A small amount of glue is placed on the inside of the small bore of head (1), and the slot end of a handle mechanism (14) is then inserted into the small bore of head (1) and twisted until the bell end of head (1) is 180° from the protruding finger of handle mechanism (14). This completes the assembly of a mesh sponge holder/back scrubber (FIG. 9) and after allowing sufficient time for the glue to dry, will be ready to use.

Operation

The exploded view at FIG. 2 shows all of the component parts that comprise my invention. The following will explain the function of each:

Head (1) pushes the surfaces of the mesh sponge forward, creating a wide and stable surface for scrubbing. The slot in head (1) allows the cord of the mesh sponge to enter through the head allowing a means by which to pull the sponge into the mouth of head (1). The purpose of plug (2) is to provide support to the end of handle (7) allowing handle (7) to retain its size and shape so that the connection between handle (7) and head (1) is solid. Plug (2) also acts as a surface for spring (3) to push against and gives access to handle (7) so that a pusher assembly (11) FIG. 4B can be installed from the same end of handle (7) since finger (5) must go into the slot end of handle (7) before spring (3). Spring (3) has only one function and that is to provide pressure or resistance to finger (5). Pilot (4) must secure finger (5) to pusher (6) while allowing pusher (6) the ability to rotate. This rotation is necessary so that cap (9) can turn to facilitate hanging the mesh sponge holder/back scrubber by a cord located through a hole in the end of cap (9). There are also other designs of cap (9) that utilize a hook which will need to be positioned appropriately for hanging. Finger (5) is the contact surface for pulling the cord of a mesh sponge tight. Pusher (6) is the means for which the spring pressure on finger (5) is overcome and released again for loading a mesh sponge onto the mesh sponge holder/back scrubber. Pusher (6) is the bridge between the force being applied on cap (9) and the resistance being applied to finger (5). Handle (7) acts as a housing for all the working internal parts and as a means of holding the invention. Gripper (8) is, as the name implies, medium used for gripping the handle (7) with ones hand. Cap (9) is used as a wide surface in which pressure can be applied against ones hip to actuate pusher (6) and thereby overcome the spring pressure on finger (5) for loading and unloading a mesh sponge. The hole in the end of cap (9) can be used as a means of hanging the invention, by inserting a cord or strap.

Loading and Unloading a Mesh Sponge

Figure 10:
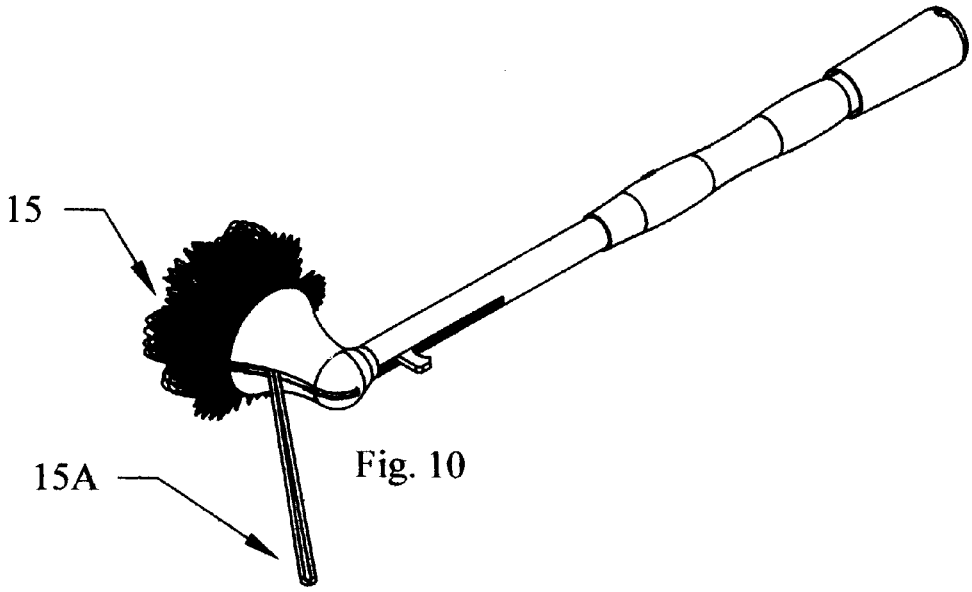
FIG. 10 shows a completed mesh sponge holder/back scrubber with a mesh sponge (15) being loaded into head (1) by pulling string (15A) of a mesh sponge through the slot in head (1).
Figure 11:
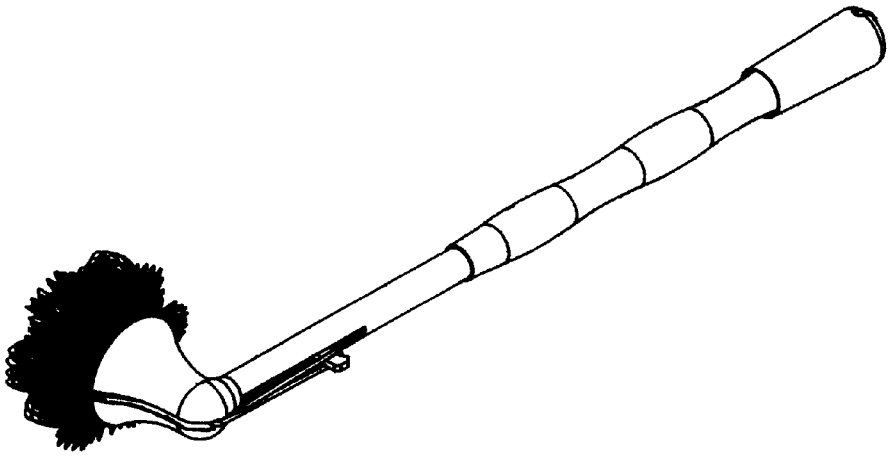
FIG. 11 shows a completed mesh sponge holder/back scrubber with a mesh sponge (15) fully loaded.

There are five basic steps to loading a mesh sponge into the mesh sponge holder/back scrubber, and are listed as follows:

1. Grip the handle with one hand at gripper (8) FIG. 10;
2. Push cap (9) FIG. 10 against the hip, leg, or side of shower or tub;
3. As shown if FIG. 10, place mesh sponge (15) in the bell shaped head of the back scrubber and pull cord (15A) through the slot in the head;
4. Loop cord (15A) FIG. 10 around finger assembly (10) as shown in FIG. 11; and
5. Release the spring pressure on cap (9) by moving the cap away from the hip, leg, or shower wall.

To release the sponge from the back scrubber, simply reverse the above steps.

Summary, Ramifications, and Scope

The present invention is a devise for securing a sponge, mesh sponge or other medium with a string or cord attached, and used for the purpose of bathing, massaging or applying a substance to the body and more precisely to ones back or other hard to reach areas of the body. The mesh sponge holder/back scrubber embodies the following:

A head (1) FIG. 8 for holding a mesh sponge.

A handle mechanism (14) FIG. 7C for operating a spring-loaded finger.

A gripper (8) FIG. 5A to allow the handle to be gripped in a wet and soapy environment.

A Cap (9) FIG. 6C for use as a wide surface for actuating the spring-loaded finger and as a means by which to hang the unit up for storage and/or to dry.

Its uniqueness lies in the manner in which the back scrubber loads, holds and uses the same mesh sponge that has already had soap applied for use in bathing the arms and body front. This is not a pad holder but is specifically designed for use as an instrument to access hard to reach areas of the body, with features to allow the quick installation and quick release of a sponge, mesh sponge or other medium, with a string or cord attached.

While my above description contains many specifications, these should not be construed as limitations on the scope of the invention, but rather as an exemplification of some of the preferred embodiments therefore. Many other variations are possible. For example the handle mechanism could have a curvature or its internal workings could be of different size, shape and/or material. The cap could be designed with a hook instead of a hole for hanging, or the head could be cone shaped instead of bell shaped. Physical changes in each part could result in material savings when manufactured and of course the aesthetic appearance, such as color or contour, of each part could be change to suit the taste of the market being pursued.

Thus the scope of the invention should be determined by the appended claims and their legal equivalents, rather than by the examples given.

I claim:

1. A back scrubber and mesh sponge holder, comprising:

a) a tubular shaped handle having an elongated slot at one end extending through a wall of the handle a distance parallel with the axis of the handle, the handle acting as a housing which includes therein a tubular shaped pusher with a spring located between the head and the pusher to provide resistance for the pusher, the handle further including a bell-shaped head mounted on the slotted end, b) the pusher having a finger at one end which extends through the elongated slot in the handle and being of sufficient length to hold a cord attached to a mesh sponge mounted within the bell-shaped head, the pusher at its other end extending through and out of the handle at the opposite end of the elongated slot to act as a means for controlling the finger and to hold a cap for pushing against, c) the cap having a socket to receive the pusher at one end, the cap being of larger diameter at its oppposite end to provide a surface area sufficient to actuate the pusher with minimal slippage from one's hand or leg when pressure is applied to the cap, and d) the bell-shaped head having a bell-shaped cavity and a slot extending through its axial length to its center axis for permitting a cord of a mesh sponge to pass therethrough and up around the finger.

2. The back scrubber and mesh sponge holder of claim 1, wherein the bell-shaped head has tapered sides.

* * * * *